US009772082B2

(12) United States Patent
Tatsukawa

(10) Patent No.: US 9,772,082 B2
(45) Date of Patent: Sep. 26, 2017

(54) VEHICULAR LAMP

(71) Applicant: KOITO MANUFACTURING CO., LTD., Tokyo (JP)

(72) Inventor: Masashi Tatsukawa, Shizuoka (JP)

(73) Assignee: KOITO MANUFACTURING CO., LTD., Minato-ku, Tokyo (JP)

( * ) Notice: Subject to any disclaimer, the term of this patent is extended or adjusted under 35 U.S.C. 154(b) by 183 days.

(21) Appl. No.: 14/332,735

(22) Filed: Jul. 16, 2014

(65) Prior Publication Data

US 2015/0023040 A1 Jan. 22, 2015

(30) Foreign Application Priority Data

Jul. 19, 2013 (JP) ..... 2013-150616

(51) Int. Cl.
*F21S 8/10* (2006.01)

(52) U.S. Cl.
CPC ..... *F21S 48/1266* (2013.01); *F21S 48/1159* (2013.01); *F21S 48/1225* (2013.01); *F21S 48/1275* (2013.01); *F21S 48/1323* (2013.01); *F21S 48/1388* (2013.01); *F21S 48/215* (2013.01); *F21S 48/2212* (2013.01)

(58) Field of Classification Search
CPC ..... F21S 48/1159; F21S 48/1225; F21S 48/1266; F21S 48/1275; F21S 48/1323; F21S 48/1388; F21S 48/2212; F21S 48/215; F21S 48/1216; F21S 48/125
See application file for complete search history.

(56) References Cited

U.S. PATENT DOCUMENTS 2,647,984 A * 8/1953 Falge ..... F21S 48/1208 24/458
4,949,226 A * 8/1990 Makita ..... B60Q 1/0041 362/247
2007/0019428 A1 1/2007 Tsukamoto et al.
2009/0067186 A1* 3/2009 Futami ..... F21S 48/1154 362/516

(Continued)

FOREIGN PATENT DOCUMENTS

DE 19519872 A1 5/1996
DE 19526023 A1 1/1997

(Continued)

OTHER PUBLICATIONS

Communication dated May 19, 2015 issued by the National Institute of Industrial Property in counterpart French Application No. 1456969.

(Continued)

*Primary Examiner* — Andrew Coughlin
*Assistant Examiner* — Christopher E Dunay
(74) *Attorney, Agent, or Firm* — Sughrue Mion, PLLC

(57) ABSTRACT

A vehicular lamp includes a projection lens, a light source disposed to the rear of the projection lens, and an additional lens. First light from the light source is irradiated to the front through the projection lens to form a predetermined light distribution pattern. The projection lens has an elongated external shape when the lamp is seen from the front. The additional lens is disposed on a circumference of the projection lens and configured to control second light from the light source to forwardly pass through the additional lens.

10 Claims, 6 Drawing Sheets

(56) References Cited

U.S. PATENT DOCUMENTS

| | | | | |
|---|---|---|---|---|
| 2011/0199776 | A1 | 8/2011 | Takahashi et al. | |
| 2011/0222162 | A1* | 9/2011 | Helbig | B29C 45/14434 359/642 |
| 2013/0223089 | A1* | 8/2013 | Danner | F21S 48/1241 362/511 |
| 2013/0235608 | A1* | 9/2013 | Tsai | G02B 6/0008 362/551 |
| 2015/0241009 | A1* | 8/2015 | Brendle | F21S 48/115 362/521 |

FOREIGN PATENT DOCUMENTS

| | | | |
|---|---|---|---|
| DE | 102004003577 | A1 | 9/2005 |
| DE | 102005050420 | A1 | 4/2007 |
| DE | 202012101225 | U1 | 6/2012 |
| EP | 0094519 | A2 | 11/1983 |
| EP | 1126210 | A2 | 8/2001 |
| JP | 62503 | U | 1/1994 |
| JP | 2003-123509 | A | 4/2003 |
| JP | 2003141913 | A | 5/2003 |
| JP | 2003-281906 | A | 10/2003 |
| JP | 2003-338210 | A | 11/2003 |
| JP | 2007-207687 | A | 8/2007 |
| JP | 2009-301786 | A | 12/2009 |
| JP | 4781951 | B2 | 9/2011 |
| JP | 2011171044 | A | 9/2011 |
| WO | 2013183240 | A1 | 12/2013 |

OTHER PUBLICATIONS

Office Action issued on Feb. 28, 2017, issued by the Japanese Patent Office in counterpart Japanese Application No. 2013-150616.

* cited by examiner

VEHICULAR LAMP

CROSS-REFERENCE TO RELATED APPLICATION

The present application claims priority from Japanese Patent Application No. 2013-150616 filed on Jul. 19, 2013, the entire content of which is incorporated herein by reference.

BACKGROUND OF INVENTION

Field of Invention

The present invention relates to a vehicular lamp.

Related Art

Projector type vehicular lamps have been known in which light from a light source disposed to the rear of a projection lens is irradiated forwards via the projection lens to thereby form a predetermined light distribution pattern.

Japanese Patent Publication No. 4781951 describes a configuration in which a plurality of projector type vehicular lamp units are provided.

When observing the vehicular lamp from the front when it is lit, since a projector type vehicular lamp only looks as if a projection lens shines in a circular shape or a shape close thereto and a sufficient light emitting area cannot be ensured, it is not easy to enhance the visibility of the vehicular lamp when the vehicular lamp is lit.

To deal with this problem as in the vehicular lamp described in Japanese Patent Publication No. 4781951 above, the plurality of projector type lamp units are provided, and these lamp units are lit simultaneously. This can increase the light emitting area of the lamp as a whole, whereby the visibility of the lamp when it is lit can be improved accordingly.

Even in such a case, however, a plurality of projection lens only look as if they shine in a circular shape or a shape close thereto in different locations. Because of this, the way in which the vehicular lamp shines as a whole lacks unexpectedness, and in this respect, the visibility of the vehicular lamp when it is lit cannot be enhanced.

SUMMARY OF INVENTION

Exemplary embodiments of the invention provide a vehicular lamp which can enhance the visibility thereof when it is lit.

Exemplary embodiments of the invention make some variation for an external shape of a projection lens in addition to disposing an additional lens on a circumference of the projection lens.

A vehicular lamp according to an exemplary embodiment, comprises:

a projection lens;

a light source disposed to the rear of the projection lens; and an additional lens, wherein first light from the light source is irradiated to the front through the projection lens to form a predetermined light distribution pattern, wherein the projection lens has an elongated external shape when the lamp is seen from the front, and wherein the additional lens is disposed on a circumference of the projection lens and configured to control second light from the light source to forwardly pass through the additional lens.

The vehicular lamp may be configured so that light from the light source is incident on the projection lens as direct light or light from the light source is reflected by a reflector to be incident on the projection lens.

The type of the "light source" is not limited to any particular type, and hence, for example, a light emitting device such as a light emitting diode or a laser diode or a light source bulb can be adopted as the light source.

As long as the "projection lens" has an external shape which is elongated when the lamp is seen from the front, there is imposed no specific limitation on the direction in which the projection lens is elongated or the specific external shape thereof. In this case, it is meant by "is elongated" that a longitudinal length of the projection lens is 1.5 times or more a length in a direction which intersects the longitudinal direction at right angles.

There is imposed no specific limitation on the "predetermined light distribution pattern" and hence, for example, a light distribution pattern for a low beam, a light distribution pattern for a high beam, a light distribution pattern for a fog lamp or the like can be adopted.

There is no specific limitation on the disposition or configuration of the "additional lens" as long as the additional lens is disposed on the circumference of the projection lens.

As seen in the configuration described above, although the vehicular lamp according to the exemplary embodiment is configured as the projector type lamp, the projection lens thereof has the external shape which is elongated when the lamp is seen from the front, and the additional lens which controls the light from the light source to forwardly pass through the additional lens is disposed on the circumference of the projection lens. Therefore, the following effects can be obtained.

Namely, when observing the vehicular lamp from the front when it is lit, the projection lens which has the elongated external shape when the lamp is seen from the front looks shining in the elongated shape and the additional lens also looks shining on the circumference of the projection lens.

Because of this, compared with the related-art vehicular lamp in which the projection lens looks shining in the circular shape or the shape close thereto, the vehicular lamp of the exemplary embodiment is allowed to look shining in an unexpected way. Additionally, since the additional lens looks shining in addition to the projection lens, it is possible to increase the light emitting area. Then, this can enhance the visibility of the vehicular lamp when it is lit.

In this way, according to the exemplary embodiment, the visibility of the projector type vehicular lamp when it is lit can be enhanced.

When the additional lens is configured to diffuse the second light that has forwardly passed through the additional lens, even if the vehicular lamp is observed at various angles from the front thereof, the additional lens is allowed to look shining.

When the additional lens has an elongated external shape when the lamp is seen from the front and is disposed so that a longitudinal direction of the additional lens intersects a longitudinal direction of the projection lens, the additional lens is allowed to look shining in an elongated shape in a direction which differs from a direction in which the projection lens looks shining. This can provide a more unexpected way of shining when the lamp is lit.

In this case, there is imposed no specific limitation on the angle at which the longitudinal direction of the additional lens and the longitudinal direction of the projection lens intersect each other.

When the vehicular lamp comprises first and second reflectors configured to reflect the second light from the light source twice so as to cause the second light so reflected to be incident on the additional lens, the light is allowed to be incident on the additional lens with good accuracy, whereby the additional lens is allowed to emit the light with good efficiency.

When the vehicular lamp comprises a second optical unit disposed on the circumference of the projection lens, the following effects can be obtained.

Namely, since it is relatively easy to ensure a space around the projection lens having the elongated external shape, it is relatively easy to adopt a configuration in which a second optical unit is disposed on the circumference of the projection lens in addition to the additional lens. Then, by adopting this configuration, the space efficiency can be enhanced to enhance, in turn, the lamp function.

In this case, there is imposed no specific limitation on the configuration of the "second optical unit" as long as the "second optical unit" includes a light source and a light control member which controls light from the light source.

DETAILED DESCRIPTION

Hereinafter, an embodiment of the invention will be described by using the drawings.

Figure 1:
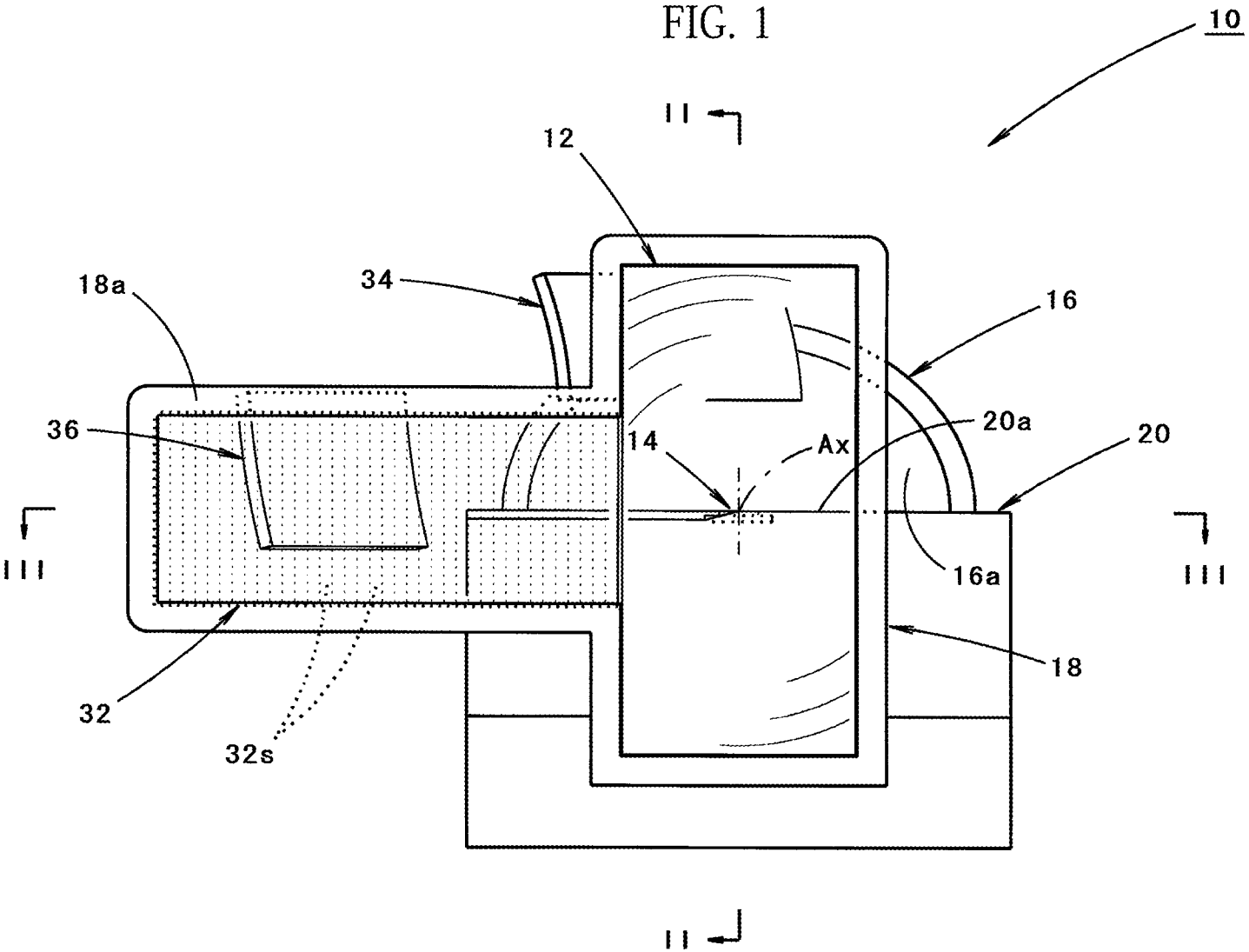
FIG. 1 is a front view of a vehicular lamp according to an embodiment of the invention.
Figure 2:
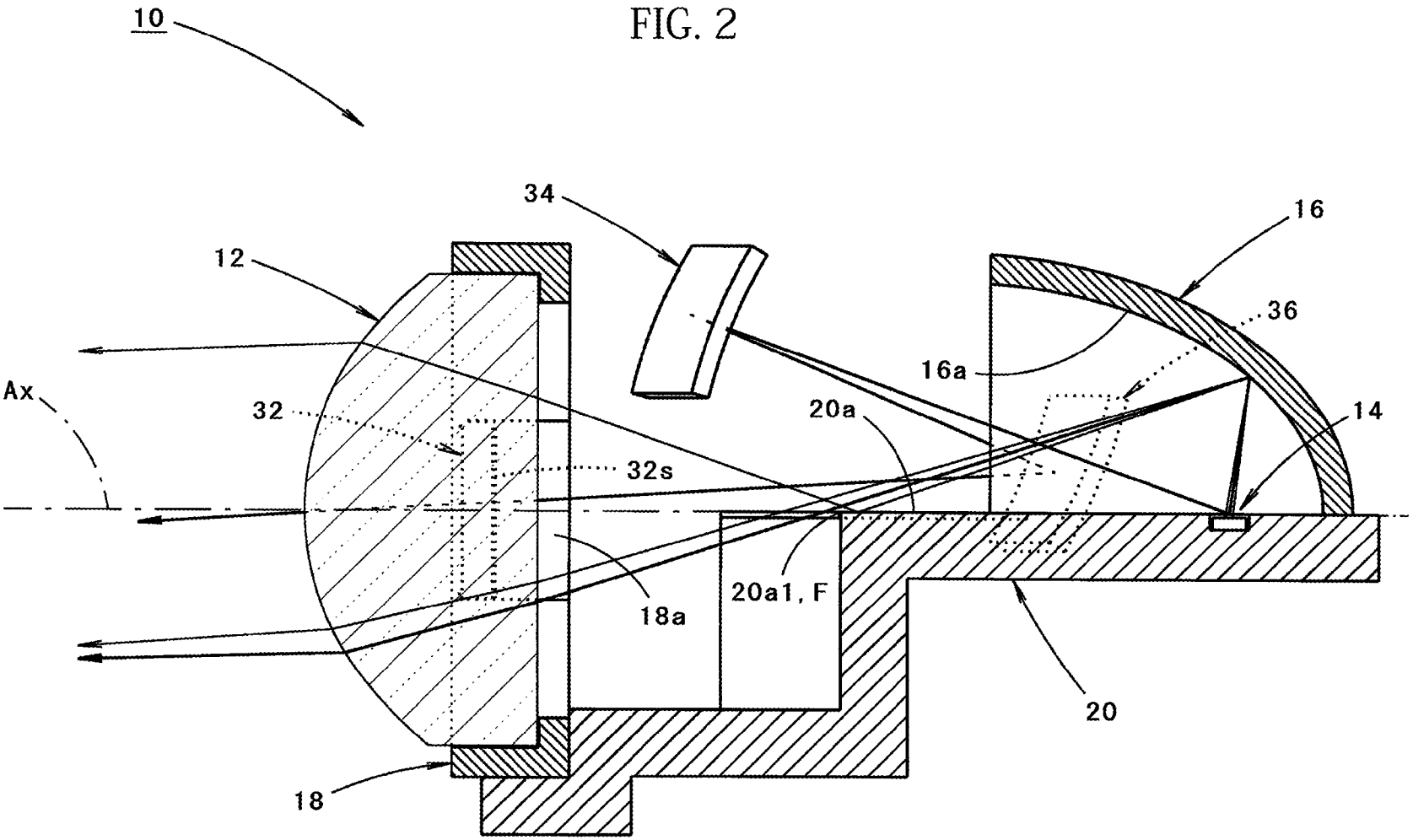
FIG. 2 is a sectional view taken along the line II-II in FIG. 1.

FIG. 1 is a front view of a vehicular lamp 10 according to an embodiment of the invention. FIG. 2 is a sectional view taken along the line in FIG. 1, and FIG. 3 is a partially sectional plan view taken along the line III-III in FIG. 1.

As shown in these drawings, the vehicular lamp 10 according to the embodiment is a headlamp for a low beam which is provided at a front end portion of a vehicle and is configured as a projector type lamp.

Namely, the vehicular lamp 10 includes a projection lens 12 having an optical axis Ax which extends in a front-to-rear direction of the vehicle, a light emitting device 14 which is disposed further rearwards than a rear focal point F of the projection lens 12, a reflector 16 which is disposed so as to cover the light emitting device 14 from thereabove and which reflects light from the light emitting device 14 towards the projection lens 12, and a mirror member 20 having an upwardly oriented reflecting plane 20*a* which reflects upwards part of the reflected light from the reflector 16.

Figure 3:
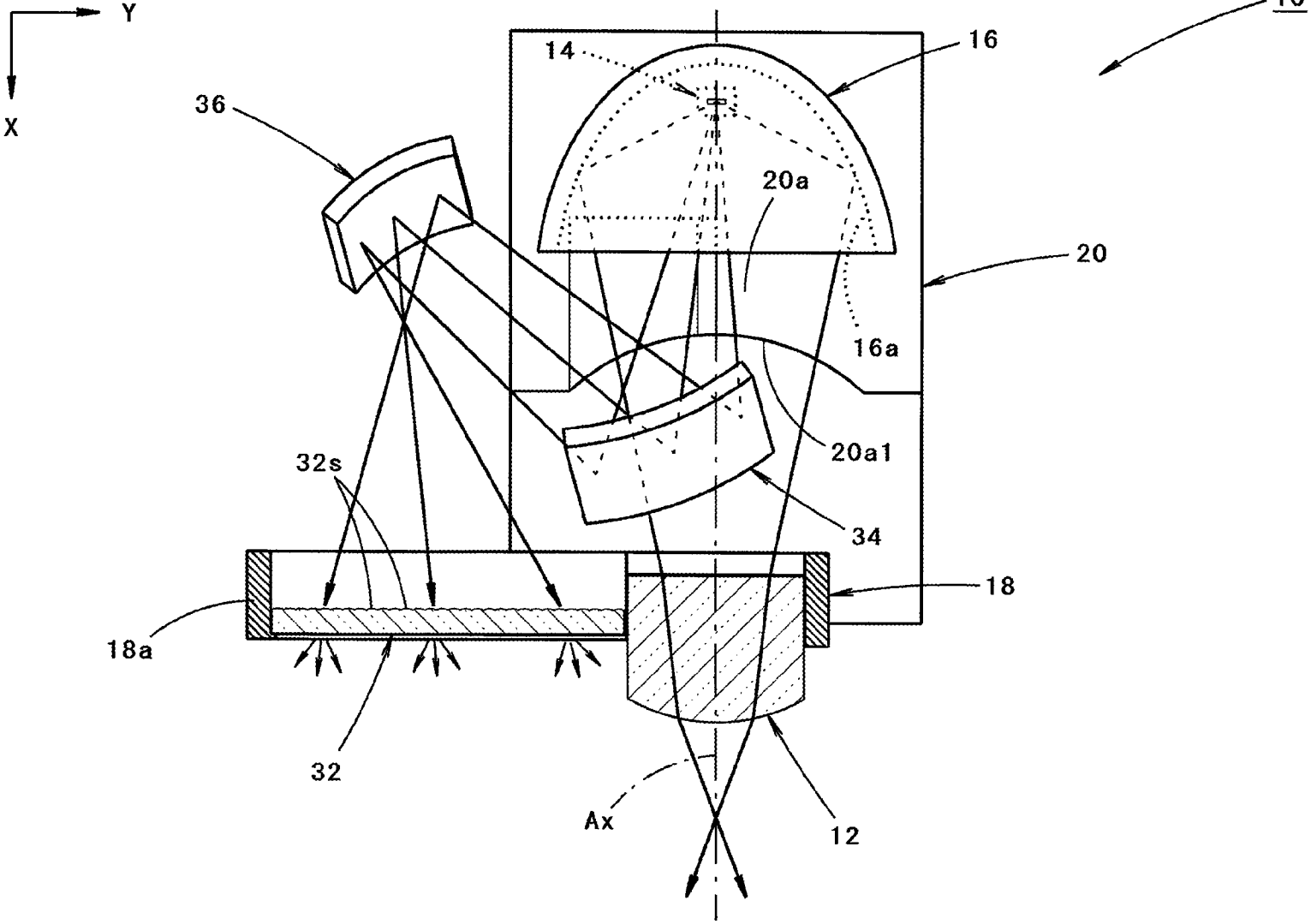
FIG. 3 is a partially sectional plan view taken along the line in FIG. 1.

It is noted that in FIG. 3, a direction denoted by X indicates a "forward direction", of the vehicle and the vehicular lamp 10 and a direction denoted by Y indicates a "leftward direction" which intersects the "forward direction" at right angles.

The light emitting device 14 and the reflector 16 are supported on the mirror member 20, and the projection lens 12 is supported on the mirror member 20 via a lens holder 18.

The projection lens 12 is a planoconvex aspheric lens for which a front surface is convex and a rear surface is plane and projects a light source image formed on a rear focal plane which is a focal plane including the rear focal point F thereof onto an imaginary vertical screen ahead of the lamp as a reverted image.

The projection lens 12 has an elongated external shape when it is seen from the front. Specifically, the projection lens 12 has a vertically rectangular external shape which is centered at the optical axis Ax, and a vertical length is set to a value which is 1.5 times or more (for example, on the order of 2 to 3 times) a horizontal length.

The light emitting device 14 is a light emitting diode which emits white light and has a horizontally rectangular light emitting plane. The light emitting device 14 is disposed to face upwards with its light emitting plane positioned on a horizontal plane which includes the optical axis Ax.

A reflecting plane 16*a* of the reflector 16 has a major axis which is coaxial with the optical axis Ax and includes a substantially ellipsoidal curved surface whose first focal point coincides with a light emitting center of the light emitting device 14. Additionally, the eccentricity of the reflecting plane 16*a* is set so as to gradually increase from a vertical section towards a horizontal section. In the reflector 16 which is configured in the way described above, light from the light emitting device 14 converges on a point which is situated slightly forwards of the rear focal point F in a vertical section, while in a horizontal section, the converging position is shifted quite forwards.

The upwardly oriented reflecting plane 20*a* of the mirror member 20 is formed by mirror finishing an upper surface of the mirror member 20 through aluminum deposition or the like. A left-hand side area of the upwardly oriented reflecting plane 20*a* which is situated further leftwards (rightwards when the lamp is seen from the front) than the optical axis Ax is formed of a horizontal plane which includes the optical axis Ax, and a right-hand side area which is situated further rightwards than the optical axis Ax is formed of a horizontal plane which is lower by one step than the left-hand side area via a short slope. A front end edge 20*a*1 of the upwardly oriented reflecting plane 20*a* extends in both leftward and rightward directions from the rear focal point F while being curved to the front along a meridional image surface of the projection lens 12. Additionally, the upwardly oriented reflecting plane 20*a* is formed in an area ranging from the front end edge 20*a*1 thereof to a position which lies a certain distance rearwards of the front end edge 20*a*1.

The mirror member 20 reflects upwards part of reflected light which travels from the reflecting plane 16*a* of the reflector 16 towards the projection lens 12 on the upwardly oriented reflecting plane 20*a* so as to be incident on the projection lens 12, and the light which enters the projection lens 12 is then irradiated from the projection lens 12 as downwardly oriented light. Then, the light irradiated from the projection lens 12 forms a light distribution pattern for a low beam for a left-hand side traffic which has a cut-off line which is uneven in level along the horizontal direction.

In the vehicular lamp 10 according to the embodiment, an additional lens 32 is disposed on a circumference of the projection lens 12, and the additional lens 32 controls light from the light emitting device 14 to forwardly pass through the additional lens 32. In this embodiment, the light from the light emitting device 14 is reflected twice by first and second additional reflectors 34, 36 and is thereafter incident on the additional lens 32.

The additional lens 32 is formed of a colorless transparent plate-shaped member which extends along a vertical plane which is at right angles to the optical axis Ax. A plurality of diffuse lens elements 32*s* which vertically extend are formed into vertical stripes on a rear surface of the additional lens 32.

When the lamp is seen from the front, the additional lens 32 has an elongated external shape. Specifically, the additional lens 32 has a horizontally rectangular external shape, and its horizontal length is set to a value which is 1.5 times or more (for example, on the order of 2 to 6 times) its vertical length.

Additionally, the additional lens 32 is disposed in such a way that the center of the horizontally rectangular external shape is positioned on a horizontal plane which includes the optical axis Ax and that a left end face thereof lies close to a right end face of the projection lens 12. Namely, the additional lens 32 is disposed in such a state that a longitudinal direction (that is, a lateral direction) thereof intersects a longitudinal direction (that is, a vertical direction) of the projection lens 12 at right angles.

The first additional reflector 34 is disposed further forwards than the reflector 16 so as to reflect direct light which travels forwards from the light emitting device 14 obliquely to the rear.

Specifically, the first additional reflector 34 is disposed further rearwards than the projection lens 12 and higher than the optical axis Ax to such a height that reflected light from the reflector 16 is not interrupted thereby. Then, the first additional reflector 34 reflects the direct light from the light emitting device 14 towards a right-hand side area of the reflector 16 as substantially parallel light in relation to the vertical direction and slightly converging light in relation to the horizontal direction.

The second reflector 36 is disposed on the right-hand side of the reflector 16 and reflects the light reflected from the first additional reflector 34 to the front.

Specifically, the second additional reflector 36 is disposed in a position where the second additional reflector 36 extends vertically across a horizontal plane which includes the optical axis Ax. Then, the second reflector 36 reflects the light reflected from the first additional reflector 34 towards the additional lens 32 as substantially parallel light in relation to the vertical direction and as light which once converges and thereafter diffuses in relation to the horizontal direction.

The light from the light emitting device 14 which is reflected sequentially at the first and second additional reflectors 34, 36 and which then reaches the additional lens 32 is emitted to the front as light which is diffused further to the left and right by the individual diffuse lens elements 32*s*.

The light emitted from the additional lens 32 diffuses to the left and right at quite a large angle, and due to this, the light does not contribute to formation of a light distribution pattern for a low beam.

The lens holder 18 has a vertically elongated frame shape which surrounds the projection lens 12. A horizontally oriented frame portion 18*a* which projects rightwards is formed in a vertically central portion of the vertically elongated frame shape. Then, the additional lens 32 is supported in the horizontally oriented frame portion 18*a* of the lens holder 18.

The first and second additional reflectors 34, 36 are supported on the mirror member 20 via corresponding supporting members, not shown. Also, the lens holder 18 is supported on the mirror member 20 at lower end portions thereof Next, the effects of the embodiment will be described.

While the vehicular lamp 10 according to the embodiment is configured as the projector type lamp, since the projection lens 12 thereof has the elongated external shape when the lamp is seen from the front, and the additional lens 32, which controls the light from the light emitting device 14 to forwardly pass through the additional lens 32, is disposed on the circumference of the projection lens 12, the following effects can be obtained.

Namely, when observing the vehicular lamp 10 according to the embodiment from the front with the light emitting device 14 lit, the projection lens 12 having the elongated external shape when the lamp is seen from the front looks shining in an elongated shape, and the additional lens 32 also looks shining on the circumference of the projection lens 12.

Because of this, compared with the related-art vehicular lamp in which the projection lens looks shining in the circular shape or the shape close thereto, the vehicular lamp 10 according to the embodiment can provide the unexpected way of shining. Additionally, since not only the projection lens 12 but also the additional lens 32 looks shining, it is possible to increase the light emitting area of the vehicular lamp 10. Consequently, it is possible to enhance the visibility of the vehicular lamp 10 when it is lit.

In this way, according to the embodiment, in the projector type vehicular lamp 10, it is possible to enhance the visibility thereof when it is lit.

In the embodiment, since the projection lens 12 has the vertically rectangular external shape, the following effects can be obtained.

Namely, the reflected light from the reflector 16 reaches the projection lens 12 directly or after having been reflected upwards by the mirror member 20. However, a light incident area on the rear surface of the projection lens 12 becomes a vertical elliptical area which is centered at the optical axis Ax, and therefore, although the external shape of the projection lens 12 is not circular but is vertically rectangular, the reflected light from the reflector 16 is allowed to be incident on the projection lens 12 with good efficiency.

Additionally, by adopting the configuration in which the whole circumferential portions of the projection lens 12 are formed linearly, the projection lens 12 can be given a novel design.

In the embodiment, the additional lens 32 diffuses the light from the light emitting device 14 that has forwardly passed through the additional lens 32 by the plurality of diffuse lens elements 32*s* which are formed on the additional lens 32, and therefore, also when observing the vehicular lamp 10 from the front at various angles, the additional lens 32 is still allowed to look shining. In particular, in the embodiment, since the plurality of diffuse lens elements 32*s* are formed into the vertical stripes, also when observing the vehicular lamp 10 obliquely from the left front or right front at various angles, the additional lens 32 is still allowed to look shining.

In addition, in the embodiment, the additional lens 32 has the elongated external shape when the lamp is seen from the front and is disposed so that the longitudinal direction thereof intersects the longitudinal direction of the projection lens 12 at right angles, and therefore, the additional lens 32 is allowed to look shining in the elongated shape in the different direction from (specifically, the direction normal to) the direction in which the projection lens 12 looks shining. This can exhibits a more unexpected way of shining when the lamp is lit.

Further, in the embodiment, the first and second additional reflectors 34, 36 are provided as the first and second reflectors by which the light from the light emitting device 14 is reflected twice to be incident on the additional lens 32 thereafter. This allows the light to be incident on the additional lens 32 with good accuracy, whereby the additional lens 32 is allowed to emit the light with good efficiency.

In the embodiment, while the plurality of vertically extending diffuse lens elements 32*s* are formed on the rear surface of the additional lens 32, it is also possible to adopt a configuration in which a diffuse lens element 32*s* taking the form of a fish-eye lens is formed on the rear surface or the front surface of the additional lens 32 or a configuration in which the rear surface or the front surface of the additional lens 32 is finished with embossing or frosting.

In the embodiment, while the projection lens 12 is described as having the vertically rectangular external shape when the lamp is seen from the front, it is possible to adopt a configuration in which the projection lens 12 has any other external shapes than that vertically rectangular external shape (for example, a horizontally rectangular shape, a trapezoidal shape, a parallelogram shape, an oval shape and the like).

In the embodiment, while the longitudinal direction of the additional lens 32 and the longitudinal direction of the projection lens 12 are described as intersecting each other at right angles, it is also possible to adopt a configuration in which the additional lens 32 and the projection lens 12 are disposed at other intersecting angles than the right angle. The additional lens 32 is also allowed to look shining in the elongated shape in the different direction from the direction in which the projection lens 12 looks shining, this being able to give the vehicular lamp 10 an unexpected way of shining when the lamp is lit.

In the embodiment, the light emitted from the additional lens 32 does not contribute to the formation of the light distribution pattern for the low beam. However, the light emitted from the additional lens 32 may be allowed to contribute the formation of the light distribution pattern for the low beam by adopting a configuration in which in place of the individual diffuse lens elements 32*s* formed on the additional lens 32, diffuse lens elements having a small lateral diffusing angle or deflection lens elements are formed on the additional lens 32.

In the embodiment, while the vehicular lamp 10 is described as being configured as the low-beam headlamp, it is possible that the vehicular lamp 10 is configured as a high-beam headlamp. Additionally, it is possible that the vehicular lamp 10 is configured as a fog lamp or a daytime running lamp.

Next, modified examples made to the embodiment will be described.

Firstly, a first modified example made to the above embodiment will be described.

Figure 4:
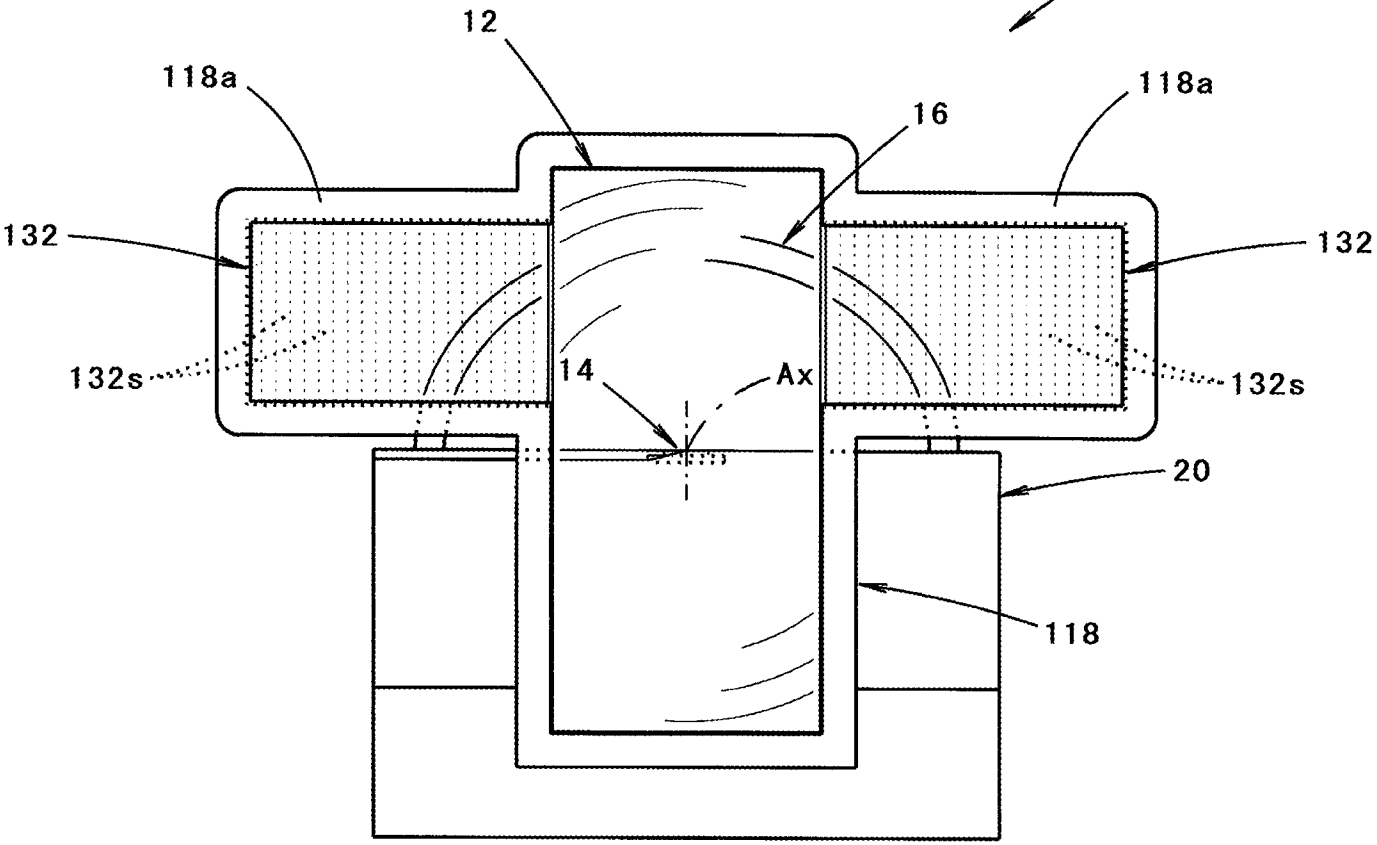
FIG. 4 is a front view of a vehicular lamp according to a first modified example of the embodiment of the invention.
Figure 5:
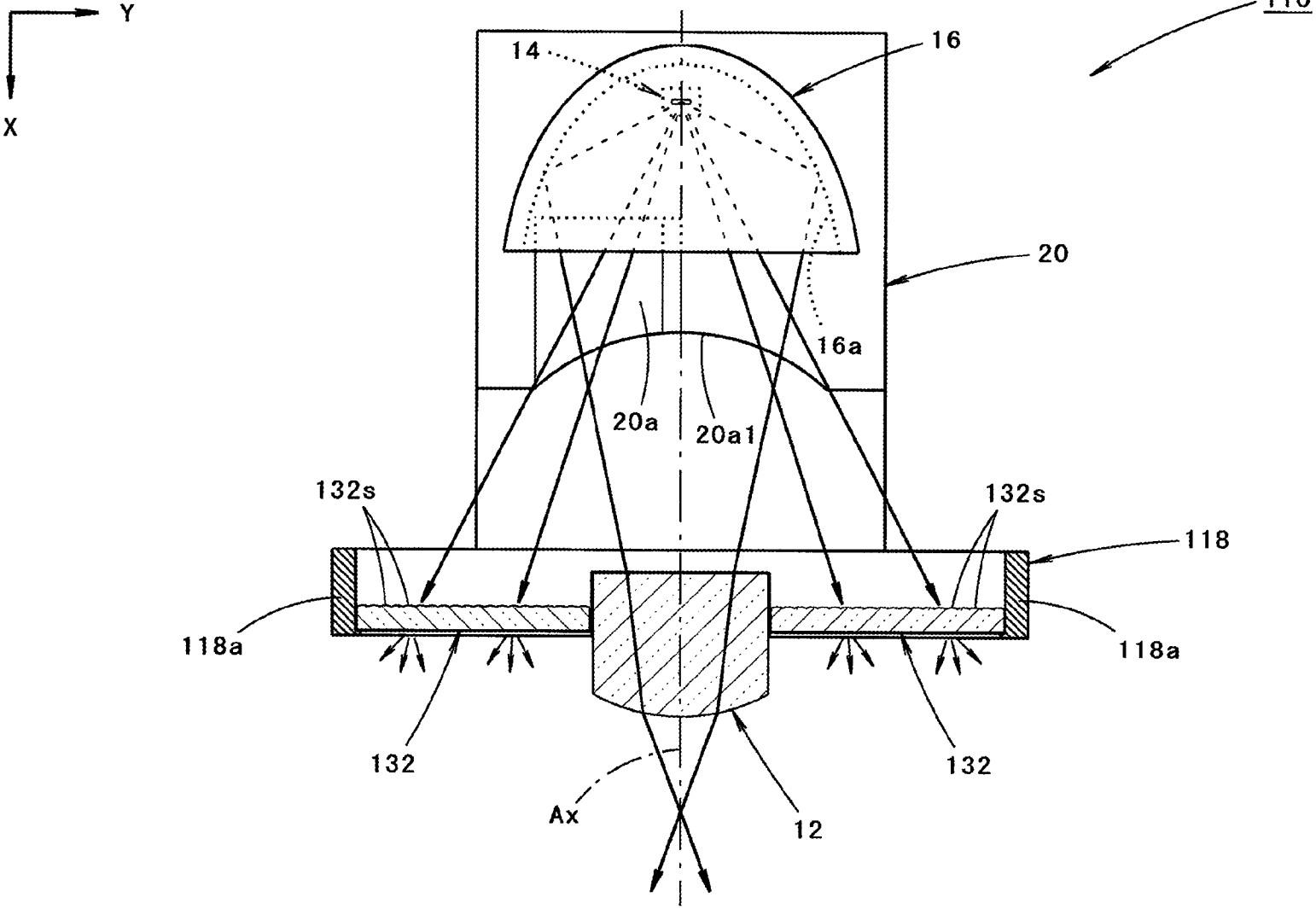
FIG. 5 is a partially sectional plan view similar to FIG. 3 in the first modified example.

FIGS. 4 and 5 are drawings similar to FIGS. 1 and 3 and show a vehicular lamp 110 according to the modified example.

As shown in these drawings, the configuration of the vehicular lamp 110 is basically similar to that of the vehicular lamp 10 of the embodiment described above, however, the shape and location of an additional lens 132 differ from those of the additional lens 132 of the above embodiment.

Namely, according to the configuration of the modified example, a couple of additional lenses 132 are disposed individually on left- and right-hand sides of a projection lens 12.

The couple of additional lenses 132 are disposed in a laterally symmetrical positional relationship with respect to an optical axis Ax and have laterally symmetrical shapes with respect to the optical axis Ax.

As this occurs, similarly to the additional lens 32 of the above embodiment, each additional lens 132 has a horizontally rectangular external shape, and a plurality of vertically extending diffuse lens elements 132*s* are formed into vertical stripes on a rear surface of the additional lens 132.

However, each additional lens 132 is formed smaller than the additional lens 32 of the above embodiment, and a ratio of a horizontal length to a longitudinal length thereof is set to a slightly smaller value (however, a value which is 1.5 times or more). In addition, these additional lenses 132 are disposed so as to be situated to some extent above a plane which contains the optical axis Ax.

In the modified example, direct light from a light emitting device 14 is allowed to be incident directly on the individual additional lenses 132 so as to be emitted towards the front therefrom as diffuse light which is caused to largely diffuse to the left and right by the diffuse lens elements 132*s*. Because of this, in the modified example, additional reflectors like the first and second additional reflectors 34, 36 of the above embodiment are not disposed.

A lens holder 118 of the modified example is formed into a vertically elongated frame shape in such a way as to surround a projection lens 12. However, a couple of laterally projecting horizontal frame portions 118*a* are formed individually at left and right upper portions of the lens holder 118. Then, the additional lenses 132 are supported individually in the corresponding horizontal frame portions 118*a*.

Also, in the case of the configuration of the modified example being adopted, since the couple of horizontally rectangular additional lenses 132 are disposed individually on the left- and right-hand sides of the projection lens 12 having the vertically rectangular shape, an unexpected way of shining when the lamp is lit can be given to the vehicular lamp 110 when it is lit.

Next, a second modified example made to the above embodiment will be described.

Figure 6:
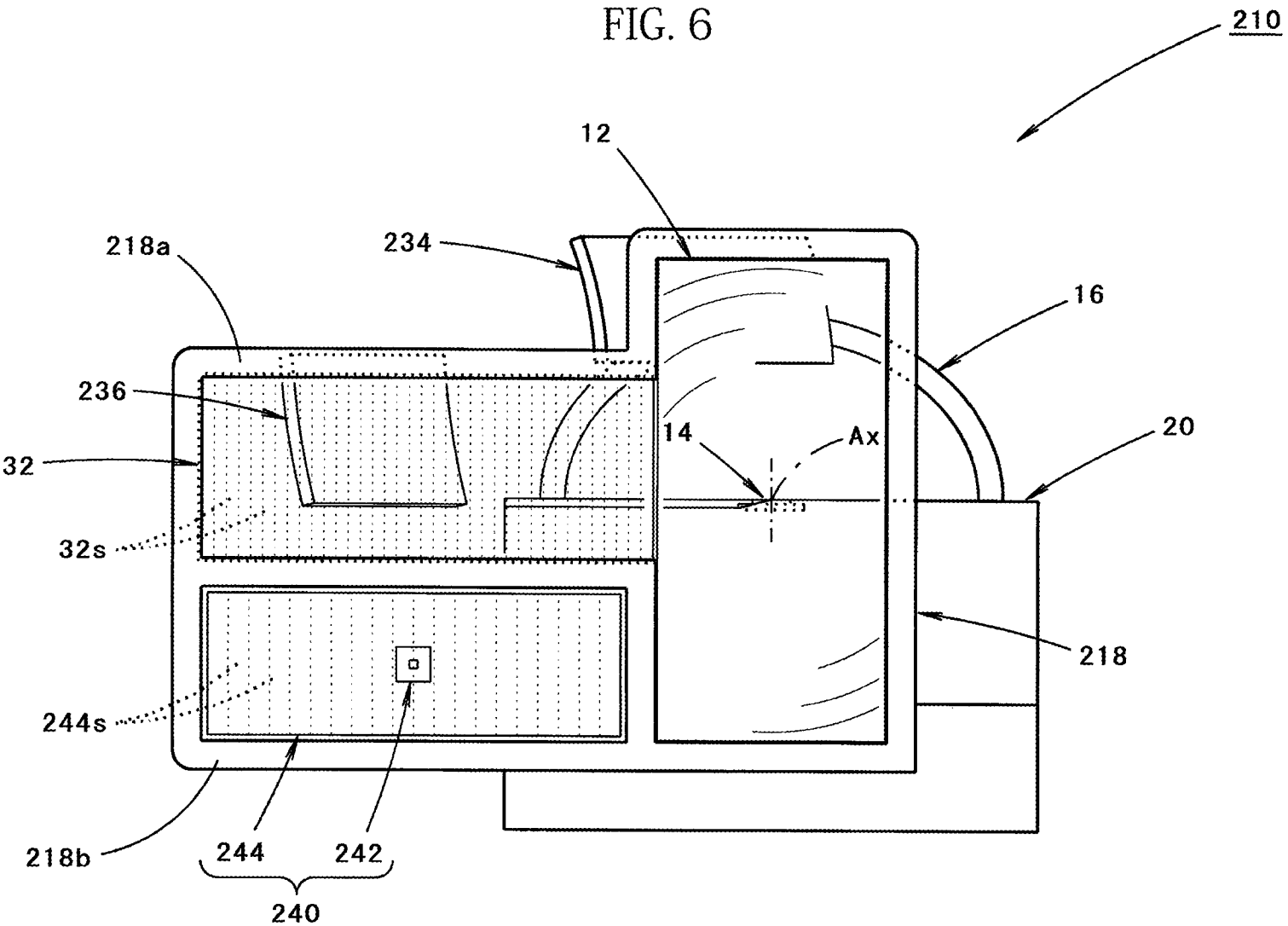
FIG. 6 is a front view of a vehicular lamp according to a second modified example of the embodiment of the invention.

FIG. 6 is a drawing similar to FIG. 1 and shows a vehicular lamp 210 according to the modified example.

As shown in the drawing, the configuration of the vehicular lamp 210 is basically similar to that of the vehicular lamp 10 of the embodiment described above, however, the vehicular lamp 210 differs from the vehicular lamp 10 in that as a second optical unit, an optical unit 240 is additionally disposed on the circumference of a projection lens 12.

The optical unit 240 is disposed so as to be situated below an additional lens 32 at a right-hand side of the projection lens 12.

As this occurs, the optical unit 240 includes a light emitting device 242 which is disposed so as to be oriented to the front of the lamp and a lens 244 which controls light from the light emitting device 242 to pass through the lens 244 and is configured to function as a clearance lamp.

The light emitting device 242 includes a light emitting diode which emits while light.

The lens 244 includes a colorless transparent plate-shaped member which extends along a vertical plane which intersects an optical axis Ax at right angles, and a plurality of vertically extending diffuse lens elements 244*s* are formed into vertical stripes on a rear surface of the lens 244. When the lamp is seen from the front, the lens 244 has a horizontally rectangular external shape and is formed into a size which is one size smaller than the additional lens 32.

In the modified example, the additional lens 32 is disposed in a position which is displaced slightly further upwards than the position of the additional lens 32 in the above embodiment, and in association with this, a first and second additional reflectors 234, 236 of the modified example are disposed in positions which are displaced slightly further upwards than the positions of the first and second additional reflectors 34, 36 in the above embodiment. Additionally, the shapes of reflecting planes of the first and second additional reflectors 234, 236 are slightly different from those of the first and second additional reflectors 34, 36 in the embodiment above.

A lens holder 218 of the modified example is configured so that a unit support portion 218*b* which supports the optical unit 240 in such a way as to surround it is formed below a horizontal frame portion 218*a* which supports the additional lens 32.

According to the configuration of the modified example in which the optical unit 240 is disposed on the circumference of the projection lens 12, the following effects can be obtained.

Namely, since spaces are ensured on the left- and right-hand sides of the projection lens 12 having the vertically rectangular external shape relatively easily, by adopting the configuration in which the optical unit 240 is disposed together with the additional lens 32 at the right-hand side (or the left-hand side) of the projection lens 12, the space efficiency can be enhanced to enhance, in turn, the lamp function.

As this occurs, since the additional lens 32 has the horizontally rectangular external shape and is disposed in the position which lies slightly further upwards than the horizontal plane which contains the optical axis Ax, the configuration can easily be achieved in which the optical unit 240 is disposed below the additional lens 32.

In the modified example, while the optical unit 240 is described as performing the lamp function as the clearance lamp, it is also possible to adopt a configuration in which the optical unit 240 performs other lamp functions than that of the clearance lamp (for example, a function to form a light distribution pattern which reinforces the diffuse area of the low-beam light distribution pattern or the like).

The numeric values shown as the specifications in the embodiment and the modified examples are only examples, and these numeric values may, of course, be set to different values as required.

The invention is not limited to the embodiment and its modified examples, and hence, it is possible to adopt other configurations than those described therein to which various modifications or alterations are applied.

What is claimed is:

1. A vehicular lamp comprising:

a projection lens having a first rectangular external shape having a first side and a second side longer the first side when the lamp is seen from a front;

a light source disposed to a rear of the projection lens; and an additional lens having a second rectangular external shape having a third side and a fourth side longer the third side when the lamp is seen from the front, wherein first light from the light source is irradiated to the front through the projection lens to form a predetermined light distribution pattern, wherein the additional lens is disposed on a circumference of the projection lens and configured to control second light from the light source to forwardly pass through the additional lens, and wherein the second side of the projection lens is larger than the third side of the additional lens, wherein a length of the second side is 1.5 times or more than a length the first side, wherein a length of the fourth side is 1.5 times or more than a length the third side.

2. The vehicular lamp according to claim 1, wherein the additional lens is configured to diffuse the second light that has forwardly passed through the additional lens.

3. The vehicular lamp according to claim 1, wherein the additional lens is disposed so that a longitudinal direction of the additional lens extending along the fourth side intersects a longitudinal direction of the projection lens extending along the second side.

4. The vehicular lamp according to claim 1, comprising:

first and second reflectors configured to reflect the second light from the light source twice so as to cause the second light so reflected to be incident on the additional lens.

5. The vehicular lamp according to claim 1, comprising:

a second optical unit disposed on the circumference of the projection lens.

6. The vehicular lamp according to claim 1, wherein a lens holder is formed into a vertically elongated frame shape in such a way as to surround the projection lens, and a couple of laterally projecting horizontal frame portions are formed individually at left and right upper portions of the lens holder.

7. The vehicular lamp according to claim 6, wherein the additional lens and a second additional lens are each supported individually in one of the laterally projecting horizontal frame portions.

8. A vehicular lamp comprising:

a projection lens having a first rectangular external shape having a first side and a second side longer the first side when the lamp is seen from a front;

a light source disposed to a rear of the projection lens; and an additional lens having a second rectangular external shape having a third side and a fourth side longer the third side when the lamp is seen from the front, wherein first light from the light source is irradiated to the front through the projection lens to form a predetermined light distribution pattern, wherein the additional lens is disposed on a circumference of the projection lens and configured to control second light from the light source to forwardly pass through the additional lens, and wherein a light emitting surface of the additional lens extends in a direction perpendicular to an extending direction of an optical axis of the projection lens along an entire length of the fourth side, wherein a length of the second side is 1.5 times or more than a length the first side, wherein a length of the fourth side is 1.5 times or more than a length the third side.

9. The vehicular lamp according to claim 8, wherein the fourth side of the additional lens extends in a perpendicular direction from a vertical plane including the optical axis of the projection lens along the entire length of the fourth side.

10. The vehicular lamp according to claim 1, wherein a first end of the additional lens along the fourth side is disposed on a circumference of the projection lens and a second end opposite to the first end along the fourth side is a free end, the additional lens.

* * * * *